US011005190B1

(12) United States Patent
Lin et al.

(10) Patent No.: US 11,005,190 B1
(45) Date of Patent: May 11, 2021

(54) ANTENNA ARRAY

(71) Applicant: Wistron Corp., New Taipei (TW)

(72) Inventors: Po-Tsang Lin, New Taipei (TW); Ying-Sheng Fang, New Taipei (TW)

(73) Assignee: WISTRON CORP., New Taipei (TW)

( * ) Notice: Subject to any disclaimer, the term of this patent is extended or adjusted under 35 U.S.C. 154(b) by 40 days.

(21) Appl. No.: 16/710,494

(22) Filed: Dec. 11, 2019

(30) Foreign Application Priority Data

Oct. 30, 2019 (TW) ..... 108139167

(51) Int. Cl.

| | |
|---|---|
| ***H01Q 21/00*** | (2006.01) |
| ***H01Q 21/08*** | (2006.01) |
| ***H01Q 7/00*** | (2006.01) |
| ***H01Q 1/38*** | (2006.01) |
| *H01Q 1/22* | (2006.01) |
| *H01Q 1/24* | (2006.01) |
| *H01Q 5/20* | (2015.01) |
| *H01Q 21/28* | (2006.01) |
| *H01Q 25/00* | (2006.01) |

(52) U.S. Cl.
CPC ..... *H01Q 21/08* (2013.01); *H01Q 1/38* (2013.01); *H01Q 7/00* (2013.01); *H01Q 1/2225* (2013.01); *H01Q 1/2283* (2013.01); *H01Q 1/243* (2013.01); *H01Q 5/20* (2015.01); *H01Q 21/28* (2013.01); *H01Q 25/00* (2013.01)

(58) Field of Classification Search
CPC ..... H01Q 1/2225; H01Q 25/00; H01Q 1/243; H01Q 5/20; H01Q 21/28; H01Q 1/2283; H01Q 5/335; H01Q 5/392
USPC ..... 343/867, 702, 893
See application file for complete search history.

(56) References Cited

U.S. PATENT DOCUMENTS 4,987,421 A 1/1991 Sunahara et al.
5,945,938 A 8/1999 Chia et al.
(Continued)

FOREIGN PATENT DOCUMENTS

CN 101924272 B 6/2013
CN 208904214 U 5/2019
(Continued)

OTHER PUBLICATIONS

European Search Report dated Jul. 3, 2020, issued in application No. EP 20151087.2.
(Continued)

*Primary Examiner* — Joseph J Lauture
(74) *Attorney, Agent, or Firm* — McClure, Qualey & Rodack, LLP

(57) ABSTRACT

An antenna array includes a dielectric substrate, a ground metal plane, a first antenna unit, a second antenna unit, a third antenna unit, and a fourth antenna unit. The first antenna unit includes a first metal loop and a first feeding metal element. The first feeding metal element is adjacent to the first metal loop. The second antenna unit includes a second metal loop and a second feeding metal element. The second feeding metal element is adjacent to the second metal loop. The third antenna unit includes a third metal loop and a third feeding metal element. The third feeding metal element is adjacent to the third metal loop. The fourth antenna unit includes a fourth metal loop and a fourth feeding metal element. The fourth feeding metal element is adjacent to the fourth metal loop.

20 Claims, 6 Drawing Sheets

(56) References Cited

U.S. PATENT DOCUMENTS

| | | | | |
|---|---|---|---|---|
| 7,053,847 | B2 | 5/2006 | Chan et al. | |
| 10,355,355 | B2 | 7/2019 | Wu et al. | |
| 2010/0315304 | A1 | 12/2010 | Tu | |
| 2012/0038519 | A1* | 2/2012 | Su | H01Q 21/28 343/702 |

FOREIGN PATENT DOCUMENTS

| | | | |
|---|---|---|---|
| TW | I667842 | B | 8/2018 |
| TW | I667842 | B | 8/2019 |
| WO | 2018/126563 | A1 | 7/2018 |

OTHER PUBLICATIONS

Tsai, Y.L.; "A Dual-band Dual-polarization Stacked Antenna Array for GPS Application;" 2018 Progress in Electromagnetics Research Symposium; Aug. 2018; pp. 2318-2323.

Kumar, G., et al.; "Broadband Microstrip Antennas;" Jan. 2003; pp. 1-216.

Chinese language office action dated Dec. 28, 2020, issued in application No. TW 108139167.

* cited by examiner

ANTENNA ARRAY

CROSS REFERENCE TO RELATED APPLICATIONS

This Application claims priority of Taiwan Patent Application No. 108139167 filed on Oct. 30, 2019, the entirety of which is incorporated by reference herein.

BACKGROUND OF THE INVENTION

Field of the Invention

The disclosure generally relates to an antenna array, and more particularly, to an antenna array with a large beam width.

Description of the Related Art

With the advancements being made in mobile communication technology, mobile devices such as portable computers, mobile phones, multimedia players, and other hybrid functional portable electronic devices have become more common. To satisfy user demand, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi and Bluetooth systems and using frequency bands of 2.4 GHz, 5.2 GHz, and 5.8 GHz.

Antenna arrays have high directivity and high gain, and they are widely used in the fields of military technology, radar detection, life detection, and health monitoring. It has become a critical challenge for current designers to design antenna arrays with large beam widths and improve the communication performance thereof.

BRIEF SUMMARY OF THE INVENTION

In an exemplary embodiment, the invention is directed to an antenna array that includes a dielectric substrate, a ground metal plane, a first antenna unit, a second antenna unit, a third antenna unit, and a fourth antenna unit. The dielectric substrate has a first surface and a second surface which are opposite to each other. The ground metal element is disposed on the second surface of the dielectric substrate. The first antenna unit includes a first metal loop and a first feeding metal element. The first feeding metal element is coupled to a first signal source and is adjacent to the first metal loop. The second antenna unit includes a second metal loop and a second feeding metal element. The second feeding metal element is coupled to a second signal source and is adjacent to the second metal loop. The third antenna unit includes a third metal loop and a third feeding metal element. The third feeding metal element is coupled to a third signal source and is adjacent to the third metal loop. The fourth antenna unit includes a fourth metal loop and a fourth feeding metal element. The fourth feeding metal element is coupled to a fourth signal source and is adjacent to the fourth metal loop. The first metal loop, the second metal loop, the third metal loop, and the fourth metal loop are all disposed on the first surface of the dielectric substrate.

In some embodiments, the first antenna unit, the second antenna unit, the third antenna unit, and the fourth antenna unit cover a first frequency band and a second frequency band of millimeter-wave operations.

In some embodiments, the first frequency band is at about 28 GHz, and the second frequency band is at about 39 GHz.

In some embodiments, each of the first metal loop, the second metal loop, the third metal loop, and the fourth metal loop substantially has a relatively large square shape.

In some embodiments, the first metal loop has a first hollow portion, the second metal loop has a second hollow portion, the third metal loop has a third hollow portion, and the fourth metal loop has a fourth hollow portion. Each of the first hollow portion, the second hollow portion, the third hollow portion, and the fourth hollow portion substantially has a relatively small square shape.

In some embodiments, the length of each of the first hollow portion, the second hollow portion, the third hollow portion, and the fourth hollow portion is substantially equal to 0.25 wavelength of the first frequency band.

In some embodiments, the first metal loop, the second metal loop, the third metal loop, and the fourth metal loop have vertical projections on the second surface of the dielectric substrate, and the entirety of each vertical projection is inside the ground metal plane.

In some embodiments, the first metal loop, the second metal loop, the third metal loop, and the fourth metal loop are substantially arranged in the same straight-line.

In some embodiments, the center-to-center distance between any adjacent two of the first metal loop, the second metal loop, the third metal loop, and the fourth metal loop is from 0.4 to 1 wavelength of the first frequency band.

In some embodiments, the first metal loop, the second metal loop, the third metal loop, and the fourth metal loop are coupled to each other.

In some embodiments, the first feeding metal element, the second feeding metal element, the third feeding metal element, and the fourth feeding metal element are embedded in the dielectric substrate and between the first surface and the second surface.

In some embodiments, each of the first feeding metal element, the second feeding metal element, the third feeding metal element, and the fourth feeding metal element substantially has an L-shape.

In some embodiments, each of the first feeding metal element, the second feeding metal element, the third feeding metal element, and the fourth feeding metal element is at least partially perpendicular to and at least partially parallel to the corresponding one of the first metal loop, the second metal loop, the third metal loop, and the fourth metal loop.

In some embodiments, each of the first feeding metal element, the second feeding metal element, the third feeding metal element, and the fourth feeding metal element is neither perpendicular to nor parallel to the corresponding one of the first metal loop, the second metal loop, the third metal loop, and the fourth metal loop.

In some embodiments, the length of each of the first feeding metal element, the second feeding metal element, the third feeding metal element, and the fourth feeding metal element is substantially equal to 0.25 wavelength of the second frequency band.

In some embodiments, a first feeding point and a second feeding point are respectively positioned at two ends of the first feeding metal element, a third feeding point and a fourth feeding point are respectively positioned at two ends of the second feeding metal element, a fifth feeding point and a sixth feeding point are respectively positioned at two ends of the third feeding metal element, and a seventh feeding point and an eighth feeding point are respectively positioned at two ends of the fourth feeding metal element.

In some embodiments, the first signal source is coupled to the first feeding point or the second feeding point so as to excite the first antenna unit, the second signal source is coupled to the third feeding point or the fourth feeding point so as to excite the second antenna unit, the third signal source is coupled to the fifth feeding point or the sixth feeding point so as to excite the third antenna unit, and the fourth signal source is coupled to the seventh feeding point or the eighth feeding point so as to excite the fourth antenna unit.

In some embodiments, a radiation pattern of the antenna array will provide a first polarization direction if the first signal source is coupled to the first feeding point, the second signal source is coupled to the third feeding point, the third signal source is coupled to the fifth feeding point, and the fourth signal source is coupled to the seventh feeding point.

In some embodiments, the radiation pattern of the antenna array will provide a second polarization direction which is substantially perpendicular to the first polarization direction if the first signal source is coupled to the second feeding point, the second signal source is coupled to the fourth feeding point, the third signal source is coupled to the sixth feeding point, and the fourth signal source is coupled to the eighth feeding point.

In some embodiments, the main beam direction of the antenna array is adjusted by changing the phase differences between the first signal source, the second signal source, the third signal source, and the fourth signal source.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the foregoing and other purposes, features and advantages of the invention, the embodiments and figures of the invention will be described in detail as follows.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
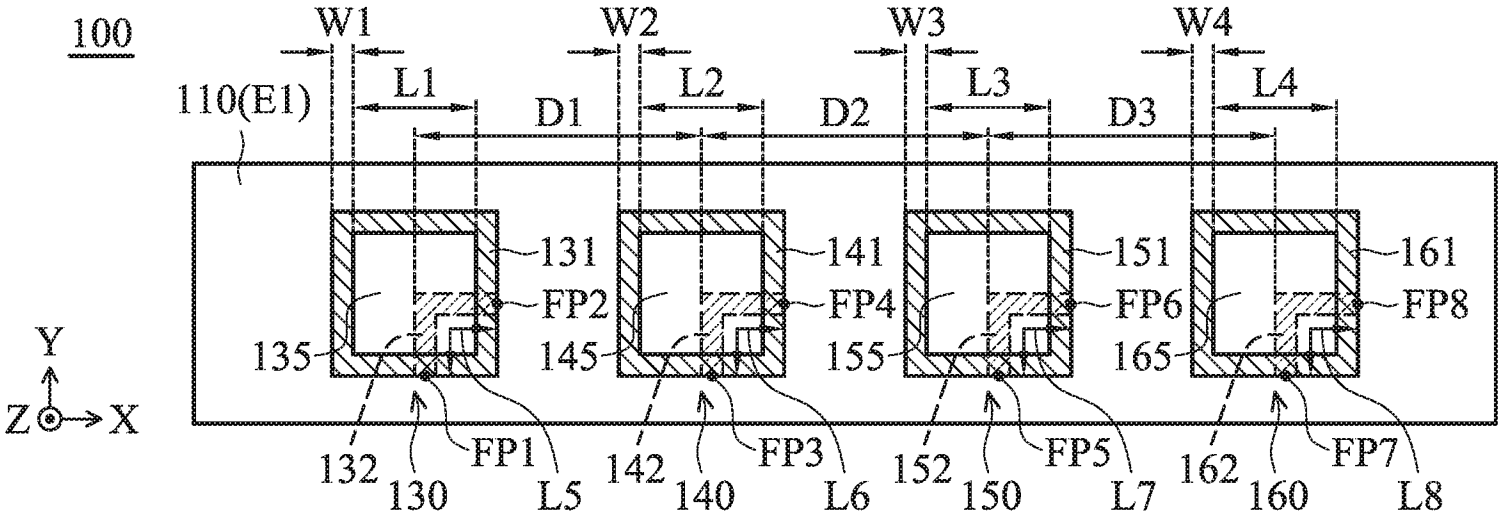
FIG. 1A is a top view of an antenna array according to an embodiment of the invention.
Figure 1B:
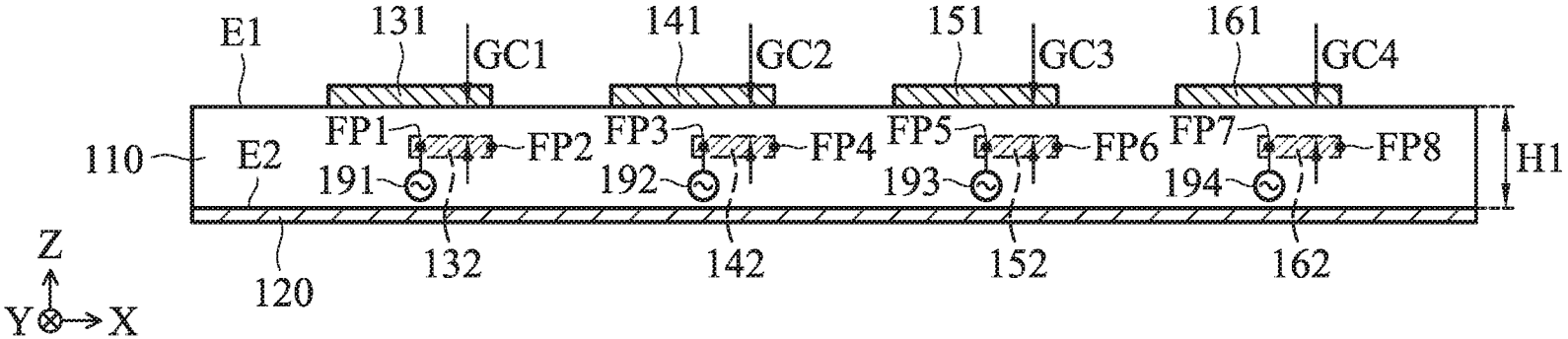
FIG. 1B is a side view of an antenna array according to an embodiment of the invention.

FIG. 1A is a top view of an antenna array 100 according to an embodiment of the invention. FIG. 1B is a side view of the antenna array 100 according to an embodiment of the invention. Please refer to FIG. 1A and FIG. 1B. The antenna array 100 may be applied to a mobile device, such as a smartphone, a tablet computer, or a notebook computer. As shown in FIG. 1A and FIG. 1B, the antenna array 100 at least includes a dielectric substrate 110, a ground metal plane 120, a first antenna unit 130, a second antenna unit 140, a third antenna unit 150, and a fourth antenna unit 160. It should be understood that the antenna array 100 may further include other elements, such as an RF (Radio Frequency) module including a plurality of signal sources, and a plurality of power amplifiers.

The dielectric substrate 110 has a first surface E1 and a second surface E2 which are opposite to each other. The ground metal plane 120 is disposed on the second surface E2 of the dielectric substrate 110, so as to provide a ground voltage. The dielectric substrate 110 may be a Rogers substrate made of, for example, an RO4350B material. However, the invention is not limited thereto. In alternative embodiments, adjustments to the design may be made to the effect that the dielectric substrate 110 may be an FR4 (Flame Retardant 4) substrate, a PCB (Printed Circuit Board), or an FCB (Flexible Circuit Board). The ground metal plane 120 may substantially have a rectangular shape to cover the whole second surface E2 of the dielectric substrate 110.

The first antenna unit 130 includes a first metal loop 131 and a first feeding metal element 132. For example, the first metal loop 131 may substantially have a relatively large square shape. The first metal loop 131 is disposed on the first surface E1 of the dielectric substrate 110. The first metal loop 131 has a first hollow portion 135. The first hollow portion 135 may substantially have a relatively small square shape. The first feeding metal element 132 may substantially have an L-shape. The first feeding metal element 132 may be at least partially perpendicular to and at least partially parallel to the first metal loop 131. The first feeding metal element 132 may be embedded in the dielectric substrate 110 and between the first surface E1 and the second surface E2. The first feeding metal element 132 is coupled to a first signal source 191 and is adjacent to the first metal loop 131. A first coupling gap GC1 may be formed between the first metal loop 131 and the first feeding metal element 132. Specifically, a first feeding point FP1 and a second feeding point FP2 are respectively positioned at two ends of the first feeding metal element 132. The first signal source 191 is coupled to either the first feeding point FP1 or the second feeding point FP2, so as to excite the first antenna unit 130. It should be noted that the term "adjacent" or "close" over the disclosure means that the distance (spacing) between two corresponding elements is smaller than a predetermined distance (e.g., 5 mm or shorter), but usually does not mean that the two corresponding elements directly touch each other (i.e., the aforementioned distance/spacing therebetween is reduced to 0).

The second antenna unit 140 includes a second metal loop 141 and a second feeding metal element 142. For example, the second metal loop 141 may substantially have a relatively large square shape. The second metal loop 141 is disposed on the first surface E1 of the dielectric substrate 110. The second metal loop 141 has a second hollow portion 145. The second hollow portion 145 may substantially have a relatively small square shape. The second feeding metal element 142 may substantially have an L-shape. The second feeding metal element 142 may be at least partially perpendicular to and at least partially parallel to the second metal loop 141. The second feeding metal element 142 may be embedded in the dielectric substrate 110 and between the first surface E1 and the second surface E2. The second feeding metal element 142 is coupled to a second signal source 192 and is adjacent to the second metal loop 141. A second coupling gap GC2 may be formed between the second metal loop 141 and the second feeding metal element 142. Specifically, a third feeding point FP3 and a fourth feeding point FP4 are respectively positioned at two ends of the second feeding metal element 142. The second signal source 192 is coupled to either the third feeding point FP3 or the fourth feeding point FP4, so as to excite the second antenna unit 140.

The third antenna unit 150 includes a third metal loop 151 and a third feeding metal element 152. For example, the third metal loop 151 may substantially have a relatively large square shape. The third metal loop 151 is disposed on the first surface E1 of the dielectric substrate 110. The third metal loop 151 has a third hollow portion 155. The third hollow portion 155 may substantially have a relatively small square shape. The third feeding metal element 152 may substantially have an L-shape. The third feeding metal element 152 may be at least partially perpendicular to and at least partially parallel to the third metal loop 151. The third feeding metal element 152 may be embedded in the dielectric substrate 110 and between the first surface E1 and the second surface E2. The third feeding metal element 152 is coupled to a third signal source 193 and is adjacent to the third metal loop 151. A third coupling gap GC3 may be formed between the third metal loop 151 and the third feeding metal element 152. Specifically, a fifth feeding point FP5 and a sixth feeding point FP6 are respectively positioned at two ends of the third feeding metal element 152. The third signal source 193 is coupled to either the fifth feeding point FP5 or the sixth feeding point FP6, so as to excite the third antenna unit 150.

The fourth antenna unit 160 includes a fourth metal loop 161 and a fourth feeding metal element 162. For example, the fourth metal loop 161 may substantially have a relatively large square shape. The fourth metal loop 161 is disposed on the first surface E1 of the dielectric substrate 110. The fourth metal loop 161 has a fourth hollow portion 165. The fourth hollow portion 165 may substantially have a relatively small square shape. The fourth feeding metal element 162 may substantially have an L-shape. The fourth feeding metal element 162 may be at least partially perpendicular to and at least partially parallel to the fourth metal loop 161. The fourth feeding metal element 162 may be embedded in the dielectric substrate 110 and between the first surface E1 and the second surface E2. The fourth feeding metal element 162 is coupled to a fourth signal source 194 and is adjacent to the fourth metal loop 161. A fourth coupling gap GC4 may be formed between the fourth metal loop 161 and the fourth feeding metal element 162. Specifically, a seventh feeding point FP7 and an eighth feeding point FP8 are respectively positioned at two ends of the fourth feeding metal element 162. The fourth signal source 194 is coupled to either the seventh feeding point FP7 or the eighth feeding point FP8, so as to excite the fourth antenna unit 160.

As a whole, the first metal loop 131, the second metal loop 141, the third metal loop 151, and the fourth metal loop 161 may have the same structures, and they may be arranged in the same straight-line. In some embodiments, the first metal loop 131, the second metal loop 141, the third metal loop 151, and the fourth metal loop 161 have vertical projections on the second surface E2 of the dielectric substrate 110, and the entirety of each vertical projection is inside the ground metal plane 120. The shapes of the first metal loop 131, the second metal loop 141, the third metal loop 151, and the fourth metal loop 161 are not limited in the invention. In alternative embodiments, each of the first metal loop 131, the second metal loop 141, the third metal loop 151, and the fourth metal loop 161 substantially has a circular shape, a rectangular shape, an elliptical shape, a regular triangular shape, or a regular hexagonal shape.

Figure 2:
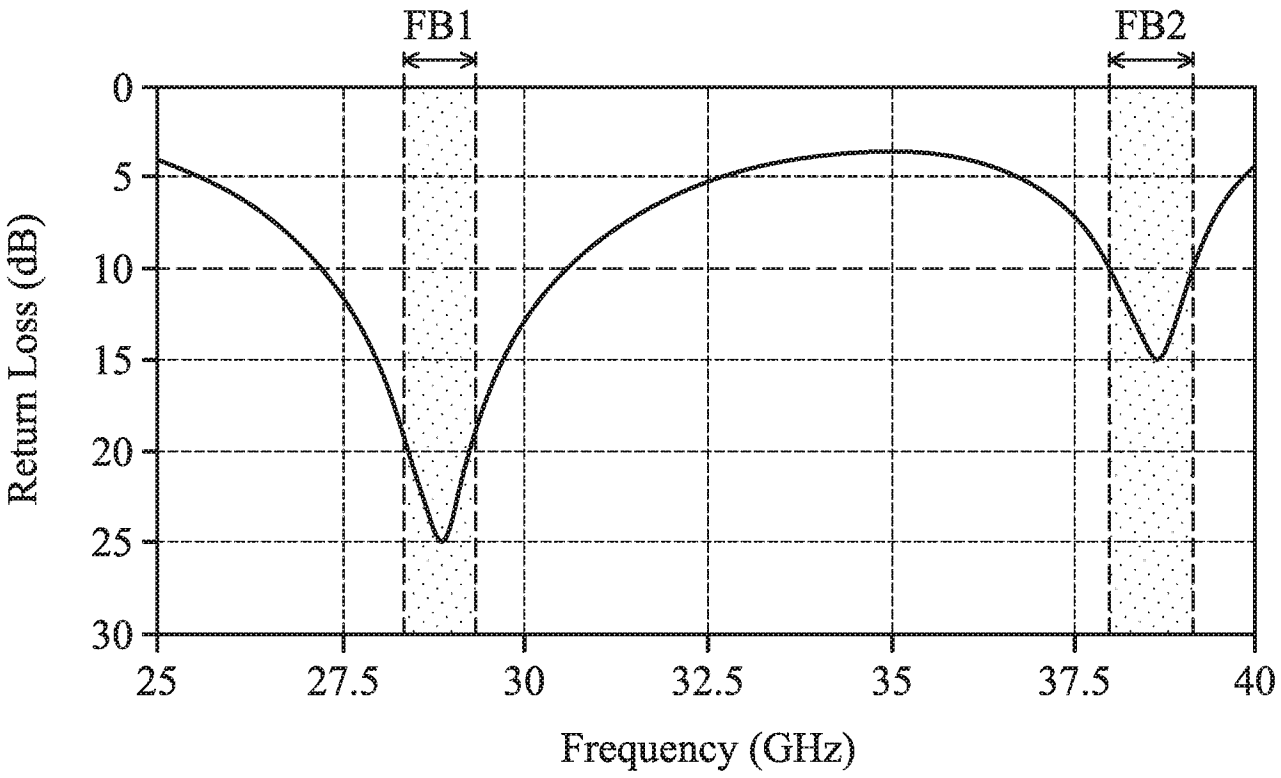
FIG. 2 is a diagram of return loss of an antenna array according to an embodiment of the invention.

FIG. 2 is a diagram of return loss of the antenna array 100 according to an embodiment of the invention. The horizontal axis represents the operation frequency (GHz), and the vertical axis represents the return loss (dB). According to the measurement of FIG. 2, the first antenna unit 130, the second antenna unit 140, the third antenna unit 150, and the fourth antenna unit 160 of the antenna array 100 can cover a first frequency band FB1 and a second frequency band FB2 of millimeter-wave operations. For example, the first frequency band FB1 may be at about 28 GHz, and the second frequency band FB2 may be at about 39 GHz. Accordingly, the antenna array 100 can support the wideband operations of next-generation 5G communication.

In some embodiments, the operation principles of the antenna array 100 are described as follows. The radiation pattern of the antenna array 100 will provide a first polarization direction if the first signal source 191 is coupled to the first feeding point FP1, the second signal source 192 is coupled to the third feeding point FP3, the third signal source 193 is coupled to the fifth feeding point FP5, and the fourth signal source 194 is coupled to the seventh feeding point FP7. Conversely, the radiation pattern of the antenna array 100 will provide a second polarization direction which is substantially perpendicular to the first polarization direction if the first signal source 191 is coupled to the second feeding point FP2, the second signal source 192 is coupled to the fourth feeding point FP4, the third signal source 193 is coupled to the sixth feeding point FP6, and the fourth signal source 194 is coupled to the eighth feeding point FP8. For example, the first polarization direction may be horizontally-polarized (parallel to the XY-plane), and the second polarization direction may be vertically-polarized (parallel to the Z-axis), but they are not limited thereto. Thus, the antenna array 100 can transmit or receive signals with different polarization directions by selecting appropriate feeding points. Furthermore, the main beam direction of the antenna array 100 is adjustable by changing the phase differences between the first signal source 191, the second signal source 192, the third signal source 193, and the fourth signal source 194. Please refer to the following embodiments of FIG. 3A and FIG. 3B.

Figure 3A:
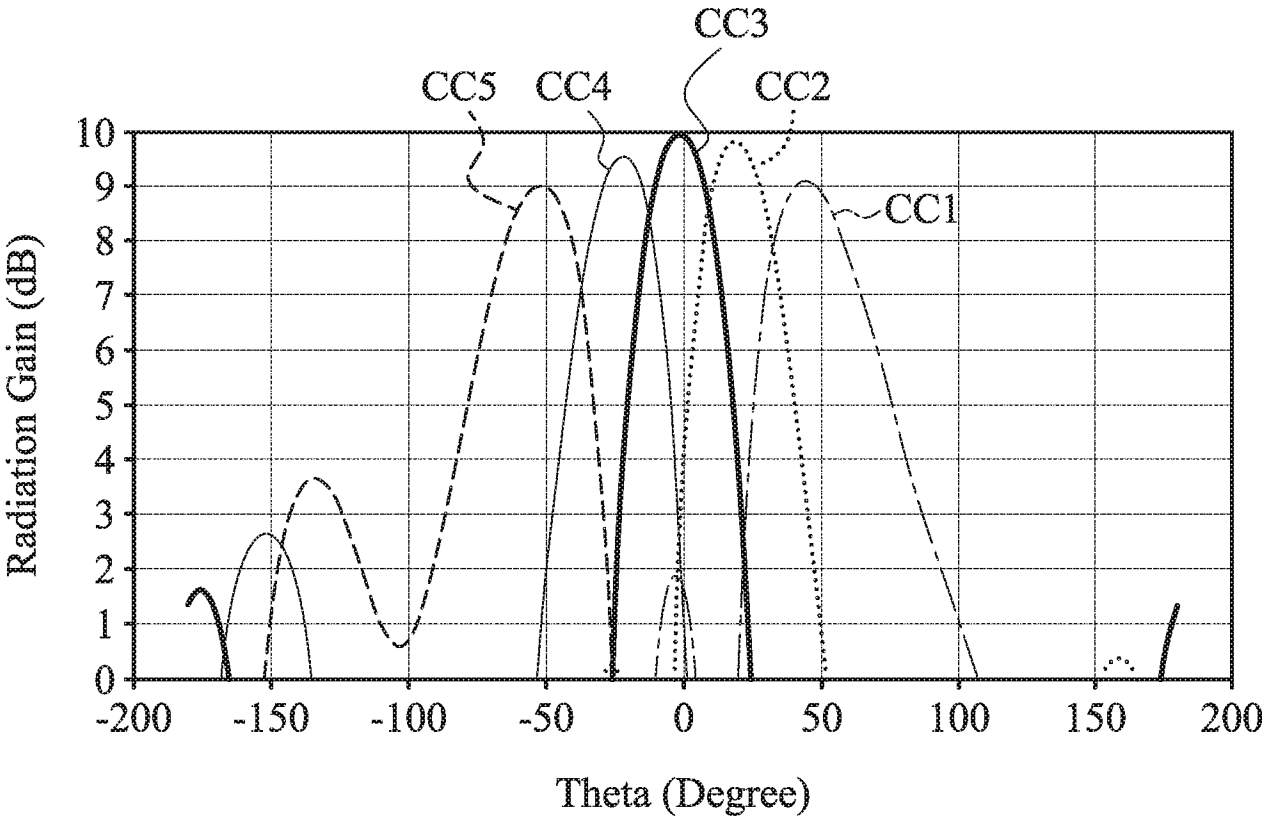
FIG. 3A is a diagram of radiation gain of an antenna array operating in a first frequency band according to an embodiment of the invention.
Figure 3B:
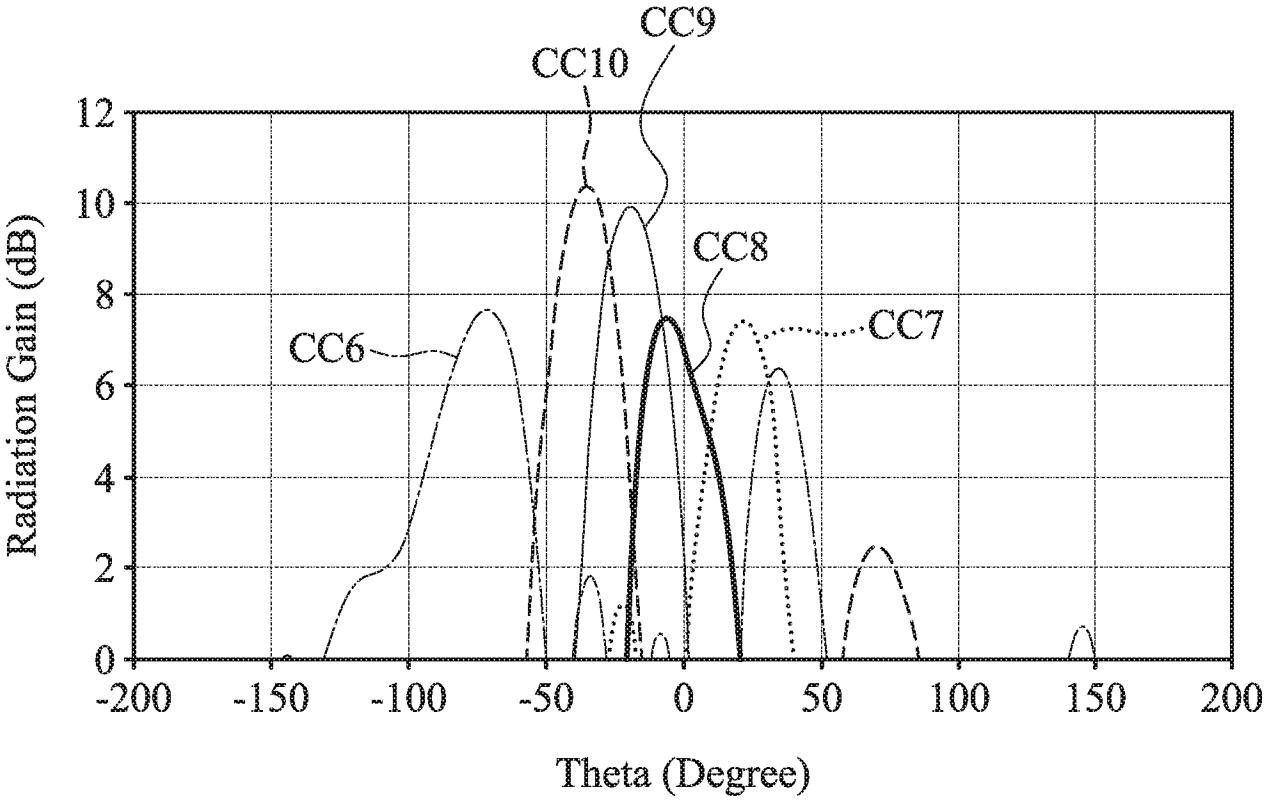
FIG. 3B is a diagram of radiation gain of an antenna array operating in a second frequency band according to an embodiment of the invention.

FIG. 3A is a diagram of radiation gain of the antenna array 100 operating in the first frequency band FB1 according to an embodiment of the invention (it may be measured on the XZ-plane). The horizontal axis represents the zenith angle (Theta) (degrees), and the vertical axis represents the radiation gain (dB). As shown in FIG. 3A, a first curve CC1 represents the radiation pattern of the antenna array 100 when the aforementioned feeding phase difference is equal to −120 degrees, a second curve CC2 represents the radiation pattern of the antenna array 100 when the aforementioned feeding phase difference is equal to −60 degrees, a third curve CC3 represents the radiation pattern of the antenna array 100 when the aforementioned feeding phase difference is equal to 0 degrees, a fourth curve CC4 represents the radiation pattern of the antenna array 100 when the aforementioned feeding phase difference is equal to 60 degrees, and a fifth curve CC5 represents the radiation pattern of the antenna array 100 when the aforementioned feeding phase difference is equal to 120 degrees. FIG. 3B is a diagram of radiation gain of the antenna array 100 operating in the second frequency band FB2 according to an embodiment of the invention. The horizontal axis represents the zenith angle (Theta) (degrees), and the vertical axis represents the radiation gain (dB). As shown in FIG. 3B, a sixth curve CC6 represents the radiation pattern of the antenna array 100 when the aforementioned feeding phase difference is equal to −120 degrees, a seventh curve CC7 represents the radiation pattern of the antenna array 100 when the aforementioned feeding phase difference is equal to −60 degrees, an eighth curve CC8 represents the radiation pattern of the antenna array 100 when the aforementioned feeding phase difference is equal to 0 degrees, a ninth curve CC9 represents the radiation pattern of the antenna array 100 when the aforementioned feeding phase difference is equal to 60 degrees, and a tenth curve CC10 represents the radiation pattern of the antenna array 100 when the aforementioned feeding phase difference is equal to 120 degrees. According to the measurements of FIG. 3A and FIG. 3B, the antenna array 100 can provide an almost omnidirectional radiation pattern by controlling its feeding phase difference, regardless of being within the first frequency band FB1 or the second frequency band FB2.

In some embodiments, the element sizes and element parameters of the antenna array 100 are described as follows. The thickness H1 of the dielectric substrate 110 may be from 0.6 mm to 1 mm, such as about 0.8 mm. The dielectric constant of the dielectric substrate 110 may be from 3 to 5, such as about 3.48. The length L1 of the first hollow portion 135 of the first metal loop 131, the length L2 of the second hollow portion 145 of the second metal loop 141, the length L3 of the third hollow portion 155 of the third metal loop 151, and the length L4 of the fourth hollow portion 165 of the fourth metal loop 161 may all be substantially equal to 0.25 wavelength (λ/4) of the first frequency band FB1 of the antenna array 100. The width W1 of the first metal loop 131, the width W2 of the second metal loop 141, the width W3 of the third metal loop 151, and the width W4 of the fourth metal loop 161 may all be from 0.1 mm to 0.5 mm, such as 0.3 mm. The length L5 of the first feeding metal element 132, the length L6 of the second feeding metal element 142, the length L7 of the third feeding metal element 152, and the length L8 of the fourth feeding metal element 162 may all be substantially equal to 0.25 wavelength (λ/4) of the second frequency band FB2 of the antenna array 100. The center-to-center distance D1 between the first metal loop 131 and the second metal loop 141, the center-to-center distance D2 between the second metal loop 141 and the third metal loop 151, and the center-to-center distance D3 between the third metal loop 151 and the fourth metal loop 161 may all be from 0.4 to 1 wavelength (0.4λ~1λ) of the first frequency band FB1 of the antenna array 100. The width of the first coupling gap GC1, the width of the second coupling gap GC2, the width of the third coupling gap GC3, and the width of the fourth coupling gap GC4 may all be from 0.1 mm to 0.3 mm, such as 0.2 mm. When the aforementioned center-to-center distances D1, D2 and D3 are all equal to 0.4 wavelength (0.4λ) of the first frequency band FB1 of the antenna array 100, the tunable shift angle of the main beam of the antenna array 100 can reach its maximum value of 63 degrees to cover the largest beam width. The antenna array 100 may have a total length of about 20 mm, a total width of about 4 mm, and a total height of about 0.8 mm. The maximum gain of the antenna array 100 may be about 10 dB. The above ranges of element sizes and element parameters are calculated and obtained according to many experiment results, and they help to optimize the total beam width, the operation bandwidth, and the impedance matching of the antenna array 100.

Figure 4:
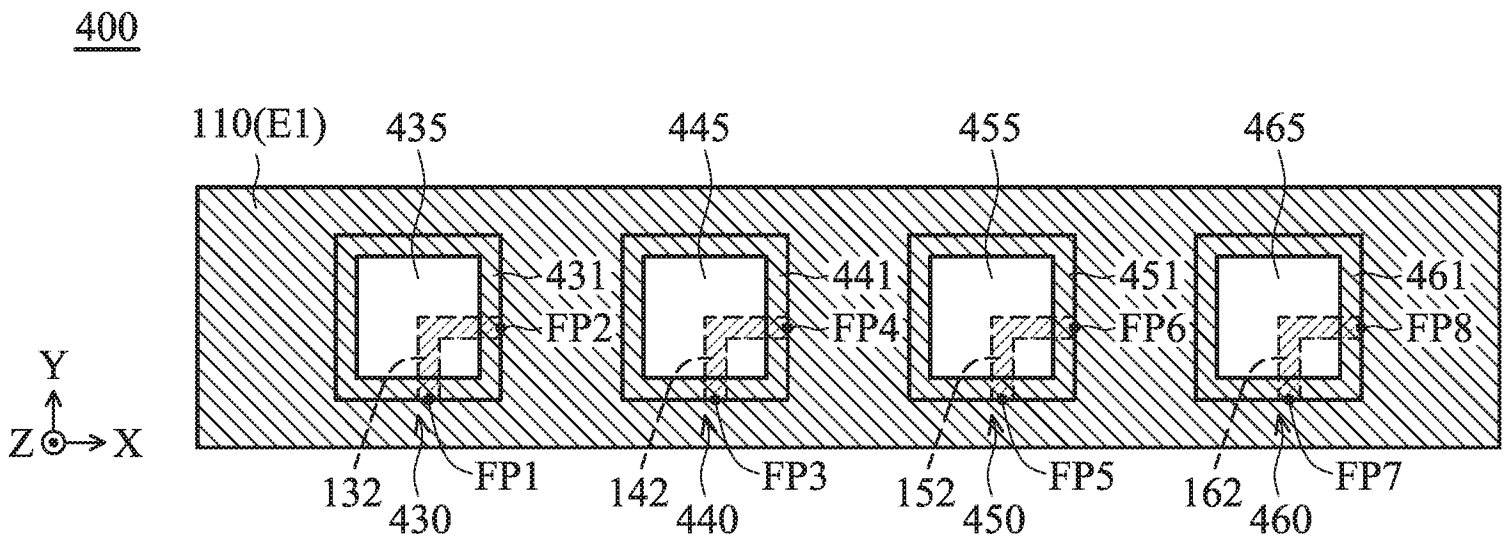
FIG. 4 is a top view of an antenna array according to another embodiment of the invention.

FIG. 4 is a top view of an antenna array 400 according to another embodiment of the invention. FIG. 4 is similar to FIG. 1A. In the antenna array 400 of the embodiment of FIG. 4, a first metal loop 431 of a first antenna unit 430, a second metal loop 441 of a second antenna unit 440, a third metal loop 451 of a third antenna unit 450, and a fourth metal loop 461 of a fourth antenna unit 460 are coupled to each other. In other words, the first surface E1 of the dielectric substrate 110 are substantially covered by metal materials, except for a first hollow portion 435 of the first metal loop 431, a second hollow portion 445 of the second metal loop 441, a third hollow portion 455 of the third metal loop 451, and a fourth hollow portion 465 of the fourth metal loop 461, which belong to non-metal regions. According to practical measurements, such an antenna pattern can increase the design flexibility and does not affect the radiation performance of the antenna array 400. Other features of the antenna array 400 of FIG. 4 are similar to those of the antenna array 100 of FIG. 1A and FIG. 1B. Therefore, the two embodiments can achieve similar levels of performance.

Figure 5:
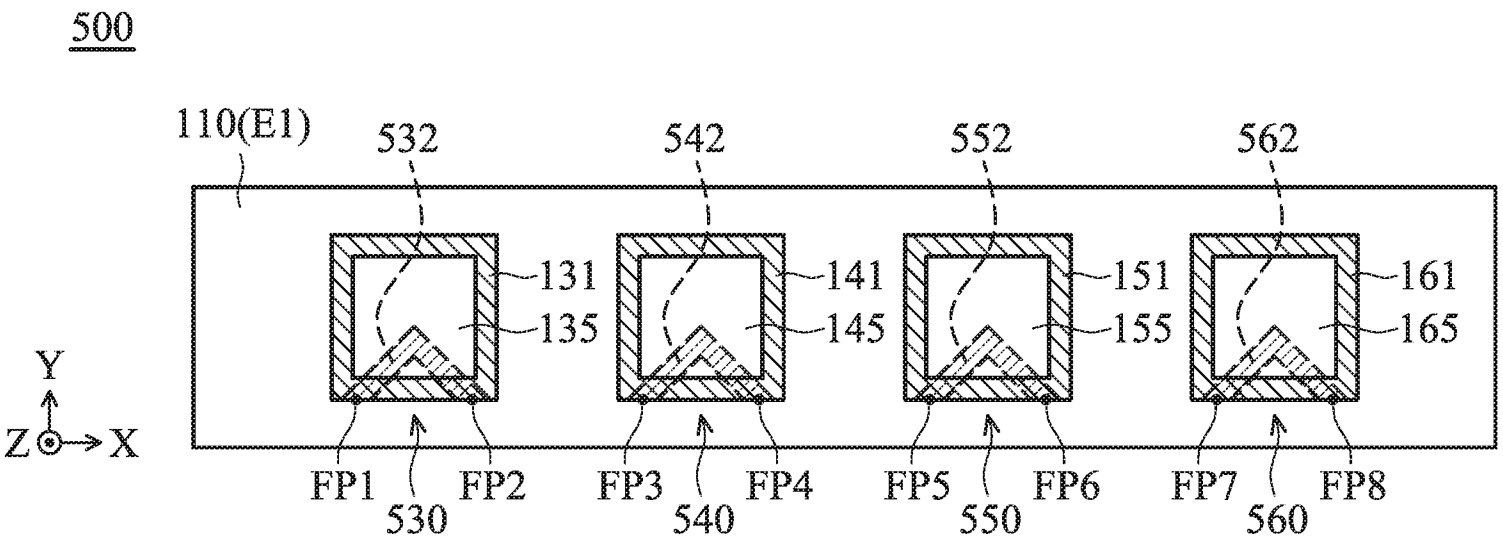
FIG. 5 is a top view of an antenna array according to another embodiment of the invention.

FIG. 5 is a top view of an antenna array 500 according to another embodiment of the invention. FIG. 5 is similar to FIG. 1A. In the antenna array 500 of the embodiment of FIG. 5, a first feeding metal loop 532 of a first antenna unit 530, a second feeding metal loop 542 of a second antenna unit 540, a third feeding metal loop 552 of a third antenna unit 550, and a fourth feeding metal loop 562 of a fourth antenna unit 560 are all rotated by 45 degrees with their respective central points. Specifically, the first feeding metal element 532 is neither perpendicular to nor parallel to the first metal loop 131, the second feeding metal element 542 is neither perpendicular to nor parallel to the second metal loop 141, the third feeding metal element 552 is neither perpendicular to nor parallel to the third metal loop 151, and the fourth feeding metal element 562 is neither perpendicular to nor parallel to the fourth metal loop 161. According to practical measurements, such an antenna pattern can increase the design flexibility and does not affect the radiation performance of the antenna array 500. Other features of the antenna array 500 of FIG. 5 are similar to those of the antenna array 100 of FIG. 1A and FIG. 1B. Therefore, the two embodiments can achieve similar levels of performance.

The invention proposes a novel antenna array including a plurality of slot antenna structures. In comparison to the conventional design, the invention has at least the advantages of large total beam width, multiple polarization directions, small size, wide bandwidth, and low manufacturing cost, and therefore it is suitable for application in a variety of mobile communication devices.

Note that the above element sizes, element shapes, element parameters, and frequency ranges are not limitations of the invention. An antenna designer can fine-tune these settings or values according to different requirements. It should be understood that the antenna array of the invention is not limited to the configurations of FIGS. 1-5. The invention may include any one or more features of any one or more embodiments of FIGS. 1-5. In other words, not all of the features displayed in the figures should be implemented in the antenna array of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. An antenna array, comprising:

a dielectric substrate, having a first surface and a second surface opposite to each other;

a ground metal plane, disposed on the second surface of the dielectric substrate;

a first antenna unit, comprising a first metal loop and a first feeding metal element, wherein the first feeding metal element is coupled to a first signal source and is adjacent to the first metal loop;

a second antenna unit, comprising a second metal loop and a second feeding metal element, wherein the second feeding metal element is coupled to a second signal source and is adjacent to the second metal loop;

a third antenna unit, comprising a third metal loop and a third feeding metal element, wherein the third feeding metal element is coupled to a third signal source and is adjacent to the third metal loop; and a fourth antenna unit, comprising a fourth metal loop and a fourth feeding metal element, wherein the fourth feeding metal element is coupled to a fourth signal source and is adjacent to the fourth metal loop;

wherein the first metal loop, the second metal loop, the third metal loop, and the fourth metal loop are disposed on the first surface of the dielectric substrate.

2. The antenna array as claimed in claim 1, wherein the first antenna unit, the second antenna unit, the third antenna unit, and the fourth antenna unit cover a first frequency band and a second frequency band of millimeter-wave operations.

3. The antenna array as claimed in claim 2, wherein the first frequency band is at about 28 GHz, and the second frequency band is at about 39 GHz.

4. The antenna array as claimed in claim 2, wherein the first metal loop has a first hollow portion, the second metal loop has a second hollow portion, the third metal loop has a third hollow portion, the fourth metal loop has a fourth hollow portion, and each of the first hollow portion, the second hollow portion, the third hollow portion, and the fourth hollow portion substantially has a relatively small square shape.

5. The antenna array as claimed in claim 4, wherein a length of each of the first hollow portion, the second hollow portion, the third hollow portion, and the fourth hollow portion is substantially equal to 0.25 wavelength of the first frequency band.

6. The antenna array as claimed in claim 2, wherein a center-to-center distance between any adjacent two of the first metal loop, the second metal loop, the third metal loop, and the fourth metal loop is from 0.4 to 1 wavelength of the first frequency band.

7. The antenna array as claimed in claim 2, wherein a length of each of the first feeding metal element, the second feeding metal element, the third feeding metal element, and the fourth feeding metal element is substantially equal to 0.25 wavelength of the second frequency band.

8. The antenna array as claimed in claim 1, wherein each of the first metal loop, the second metal loop, the third metal loop, and the fourth metal loop substantially has a relatively large square shape.

9. The antenna array as claimed in claim 1, wherein the first metal loop, the second metal loop, the third metal loop, and the fourth metal loop have vertical projections on the second surface of the dielectric substrate, and the whole vertical projections are inside the ground metal plane.

10. The antenna array as claimed in claim 1, wherein the first metal loop, the second metal loop, the third metal loop, and the fourth metal loop are substantially arranged in a same straight-line.

11. The antenna array as claimed in claim 1, wherein the first metal loop, the second metal loop, the third metal loop, and the fourth metal loop are coupled to each other.

12. The antenna array as claimed in claim 1, wherein the first feeding metal element, the second feeding metal element, the third feeding metal element, and the fourth feeding metal element are embedded in the dielectric substrate and between the first surface and the second surface.

13. The antenna array as claimed in claim 1, wherein each of the first feeding metal element, the second feeding metal element, the third feeding metal element, and the fourth feeding metal element substantially has an L-shape.

14. The antenna array as claimed in claim 1, wherein each of the first feeding metal element, the second feeding metal element, the third feeding metal element, and the fourth feeding metal element is at least partially perpendicular to and at least partially parallel to a corresponding one of the first metal loop, the second metal loop, the third metal loop, and the fourth metal loop.

15. The antenna array as claimed in claim 1, wherein each of the first feeding metal element, the second feeding metal element, the third feeding metal element, and the fourth feeding metal element is neither perpendicular to nor parallel to a corresponding one of the first metal loop, the second metal loop, the third metal loop, and the fourth metal loop.

16. The antenna array as claimed in claim 1, wherein a first feeding point and a second feeding point are respectively positioned at two ends of the first feeding metal two ends of the second feeding metal element, a fifth feeding point and a sixth feeding point are respectively positioned at two ends of the third feeding metal element, and a seventh feeding point and an eighth feeding point are respectively positioned at two ends of the fourth feeding metal element.

17. The antenna array as claimed in claim 16, wherein the first signal source is coupled to the first feeding point or the second feeding point so as to excite the first antenna unit, the second signal source is coupled to the third feeding point or the fourth feeding point so as to excite the second antenna unit, the third signal source is coupled to the fifth feeding point or the sixth feeding point so as to excite the third antenna unit, and the fourth signal source is coupled to the seventh feeding point or the eighth feeding point so as to excite the fourth antenna unit.

18. The antenna array as claimed in claim 16, wherein a radiation pattern of the antenna array provides a first polarization direction if the first signal source is coupled to the first feeding point, the second signal source is coupled to the third feeding point, the third signal source is coupled to the fifth feeding point, and the fourth signal source is coupled to the seventh feeding point.

19. The antenna array as claimed in claim 18, wherein the radiation pattern of the antenna array provides a second polarization direction substantially perpendicular to the first polarization direction if the first signal source is coupled to the second feeding point, the second signal source is coupled to the fourth feeding point, the third signal source is coupled to the sixth feeding point, and the fourth signal source is coupled to the eighth feeding point.

20. The antenna array as claimed in claim 1, wherein a main beam direction of the antenna array is adjusted by changing phase differences between the first signal source.

* * * * *